US006418646B1

(12) United States Patent
Bykov et al.

(10) Patent No.: US 6,418,646 B1
(45) Date of Patent: Jul. 16, 2002

(54) MACHINE FOR DIGGING INTO THE LOWER LAYERS OF THE GROUND

(75) Inventors: Alexandr V. Bykov, Kiev; Stanislav K. Vasilenko, Kremenchug; Andrei B. Koval, Kiev, all of (UA); Alexandr S. Kumylganov, Moscow (RU); Efim A. Kushnir, Kiev (UA); Jury M. Mamontov, Moscow (RU); Aly A. Movchan, Kremenchug; Vladimir D. Musiiko, Kiev, both of (UA); Valery D. Chernaev, Moscow (RU); Viktor I. Yakovlev, Krementschug (UA)

(73) Assignees: Obschestvo s Ogranichennoi Otvetstven nostju Nauchno-issledovatelsky i Takhnichasky T sentr "Rotor", Kiev (UA); Aktsionernoe Obschestvo Otkrytogo Tipa Aktsionernaya Kompania po Transportu Nefti "Transneft", Moscow (RU)

( * ) Notice: Subject to any disclaimer, the term of this patent is extended or adjusted under 35 U.S.C. 154(b) by 0 days.

(21) Appl. No.: 09/423,195

(22) PCT Filed: May 6, 1998

(86) PCT No.: PCT/UA98/00009

§ 371 (c)(1),
(2), (4) Date: Dec. 16, 1999

(87) PCT Pub. No.: WO98/50641

PCT Pub. Date: Nov. 12, 1998

(30) Foreign Application Priority Data

May 6, 1997

(RU) ..... 97106689

(51) Int. Cl.[7] ..... B65G 15/00

(52) U.S. Cl. ..... 37/352; 37/464; 37/190

(58) Field of Search ..... 37/139, 190, 462, 37/463, 464, 465, 352, 91, 92, 93, 104; 171/16; 299/15, 73, 75, 85.1

(56) References Cited

U.S. PATENT DOCUMENTS

| | | | | | |
|---|---|---|---|---|---|
| 3,452,461 A | * | 7/1969 | Hanson | ..... | 37/190 |
| 4,155,181 A | * | 5/1979 | Satterwhite | ..... | 37/190 |
| 4,183,158 A | * | 1/1980 | Satterwhite | ..... | 37/190 |

FOREIGN PATENT DOCUMENTS

| | | | | | |
|---|---|---|---|---|---|
| DE | 343776 | * | 8/1920 | ..... | 37/352 |
| DE | 28 40 587 | | 3/1980 | | |
| RU | 184732 | | 8/1966 | | |
| RU | 275863 | | 10/1970 | | |
| RU | 1245664 | | 7/1986 | | |
| RU | 2036280 | | 5/1995 | | |

*Primary Examiner*—Victor Batson
(74) *Attorney, Agent, or Firm*—Burns, Doane, Swecker & Mathis, L.L.P.

(57) ABSTRACT

The present invention relates to a machine for digging into the lower layers of the ground, wherein said machine comprises the following members: a base frame (1), a ground excavator (2) and a driving chain-type working organ (3) that is suspended from the frame (1) by a device (4) so as to be capable of forced rotation about two geometrical axes (17, 18). During operation of the machine, the axis (17) is perpendicular to the support surface (5) of the drive section (6) of the frame (1), while the axis (18 ) is parallel to the longitudinal axis (a—a) of said drive section (6). During operation, the rotation of the working organ (3) about the two axes (17, 18) makes it possible to dig excavations with a bottom that is horizontal or has a predetermined lateral inclination while maintaining an important width, to form sloped excavations or to dig excavations having various profiles.

15 Claims, 8 Drawing Sheets

U.S. PATENT DOCUMENTS 4,290,820 A * 9/1981 Swisher, Jr. et al. ..... 134/6
4,755,001 A * 7/1988 Gilbert ..... 299/39
4,858,347 A * 8/1989 Hanson et al. ..... 37/190
4,960,306 A * 10/1990 Kipp et al. ..... 299/41
5,058,294 A * 10/1991 Bryan, Jr. ..... 37/190
5,228,220 A * 7/1993 Bryan, Jr. ..... 37/364
5,271,186 A * 12/1993 Theurer ..... 37/104
5,857,274 A * 1/1999 Rudiger et al. ..... 37/190
5,873,186 A * 2/1999 Yoder et al. ..... 37/190
6,148,549 A * 11/2000 Bykov et al. ..... 37/352
6,154,988 A * 12/2000 Bykov et al. ..... 37/352

* cited by examiner

MACHINE FOR DIGGING INTO THE LOWER LAYERS OF THE GROUND

FIELD OF THE INVENTION

The invention relates to earth-moving machinery, in particular, to machines for digging into the lower layers of the ground, predominantly with a chain-type working organ, which can be used for removal of fertile layers of the ground and grading the route in construction and overhauling of line pipelines, in construction of the motor or railway roads, embankments, digging pits, trenches and similar earth-moving operations.

PRIOR ART

Known is a machine for digging into the lower layers of the ground incorporating base frame, ground excavator, working organ and device for the working organ suspension from the base frame, made in the form of two frames connected to each other by means of the first hinged joint, the first of the frames carrying the working organ and the second hung from the base frame by the second hinged joint, the power drives to enable rotation in the above hinged joints, the geometrical axis of the first hinged joint in the nominal working position of the machine being normal to the support surface of the drive section of the base frame. Unlike the claimed machine, in the known machine the geometrical axis of the second hinged joint is normal to the longitudinal axis and parallel to the support surface of the drive section of the base frame, which ensures lifting of the working organ into the transportation position, but does not provide the rotation of the working organ in the plane normal to the longitudinal axis of the drive section (USSR Auth. Cert. #184732, IPC E02f, 1966).

In view of the lacking ability to perform the above rotation of the working organ, the known machine can not provide a horizontal bottom or a predetermined lateral inclination of the excavation being dug, a sufficient width of the latter, or digging excavations having various profiles. Furthermore, the known machine is characterized by high dynamic loads and loss of kinetic energy in reversal of rotation of the working organ in the horizontal plane.

SUMMARY OF THE INVENTION

The goal of the invention is in the machine for digging into the lower layers of the ground, by improving the device of suspension of the working organ from the base frame, to provide digging of excavations having a horizontal bottom or a predetermined lateral inclination, increase of the excavation width and its sloping, as well as digging excavations having various profiles.

The above goal is reached by that in the machine for digging into the lower layers of the ground, incorporating a base frame, ground remover ("ground excavator" as used in the specification herein), working organ and device for the working organ suspension from the base frame, connected to each other by means of the first hinged joint frames the first of which carries a working organ, and the second suspended from the base frame by means of a device incorporating the second hinged joint, and power drives for performance of rotation in the above first and second hinged joints, the geometrical axis of the first hinged joint in the nominal working position of the machine being normal to the support surface of the base frame drive section, according to the invention the geometrical axis of the second hinged joint in the nominal working position of the machine is parallel to the longitudinal axis of the drive section of the base frame.

As a result, the claimed machine due to rotation of the working organ about the geometrical axes of both hinged joints is capable of digging excavation with a horizontal bottom or a predetermined lateral inclination, its greater width and sloping, as well as digging excavations having various profiles.

In a particular embodiment of the machine, the geometrical axis of the second hinged joint is located above the center of mass of that part of the machine, which includes the working organ and is capable of rotation about the geometrical axis of the first hinged joint.

As a result, reversal of the working organ results in conversion of the kinetic energy into potential energy and vice versa and lowering of the dynamic loads on the structural elements of the machine.

Furthermore, the working organ is made in the form of, at least, one chain portion mounted on the first edge of the first frame with the capability of rotation about the geometrical axis of the drive shaft by means of the power drive, the second edge of the first frame facing the base frame and being connected to the edge of the second frame.

As a result, due to a combination of rotation in the second hinged joint with rotation of the chain portion, the width of the dug excavation can be increased and the machine capability for profiling the excavation slopes can be expanded.

Furthermore, the device for hinging the second frame to the base frame is fitted with a third frame which is connected to the frame of the base frame by a third hinged joint, whose geometrical axis is normal to the longitudinal axis and parallel to the support surface of the drive section of the base frame, and a power drive for performance of rotation in the third hinged joint, the second frame is made detachable in the form of the front and rear semi-frames which are fastened to each other by flange joints, located in the plane which is normal to the geometrical axis of the second hinged joint with formation of a closed gap which accommodates the transverse beam of the third frame, the beam being connected to the semi-frames by the above second hinged joint.

As a result, lifting of the working equipment to the transportation position is provided, while ensuring a sufficiently compact design of the assembly including the third and second frames and the second hinged joint. In this case quite small play and the ability to transfer high loads are provided in the latter. Furthermore, the above assembly lends itself easily to manufacture and assembly operations.

In addition, the drive of the working organ and of the ground excavator is made as a power drive from the power take-off shaft of the base frame in the form of a cardan shaft connected to the latter, a gimbal drive connected to the input shaft of part of the drive of working organ and ground excavator, which is mounted on the first frame, and an intermediate shaft with two bearing supports, connected by its ends to cardan shaft and gimbal drive, the second hinged joint including a tubular axle with co-axial cylindrical holes which accommodate the cylindrical cases of bearing supports of the intermediate shaft.

This design pertains to a particular embodiment of the machine with the working organ power-driven by the power take-off shaft (PTS) of the base frame. In this case fitting the bearing support cases inside the tubular axle improves the adaptability of the machine to manufacture and assembly.

Furthermore, bearing supports are made in the form of sleeves mounted in their cases on bearings, the sleeves accommodating the ends of the intermediate shaft, the ends being connected to the sleeves by spliced or keyed joints, the above sleeves being connected by flanged joints to the cardan shaft and gimbal drive, the sleeves being fitted with elastic gaskets located between their end faces and the end faces of the intermediate shaft.

This results in a further improvement of the machine adaptability to manufacture and assembly.

Furthermore, the intermediate shaft is made as a torsion shaft.

This results in lowering of the dynamic loads in the machine transmission.

Furthermore, the machine is fitted with an automatic control system made in the form of transducers of the angle of rotation in the second hinged joint and of the angle of lateral inclination of the base frame relative to the gravity axis, device for control of rotation in the first hinged joint made in the form of the angle transducer and/or limit switches, block of information processing and control signal generation, whose first inputs are connected to the above transducers and means of control, whereas the outputs of control signals are connected to the means of control of the power drives for performance of rotation in the first and second hinged joints, and panel of indication and control, whose inputs are connected to the information outputs and the outputs are connected to the second inputs of the block of processing and control signal generation.

This results in provision of an automatic synchronous control of the power drives for performance of rotation in the first and second hinged joints.

Furthermore, the automatic control system is fitted with a transducer of the angle of rotation of the chain portion of the working organ, connected to an additional input of the block of information processing and control signal generation, whose additional control signal outputs are connected to the means of control of the power drive of rotation of the chain portion.

This makes possible automatic synchronous control of the power drives for performance of rotation in the second hinged joint and rotation of the chain portion, as well as automatic maintenance of the specified lowering of the working organ into the ground.

PREFERABLE EMBODIMENT OF THE INVENTION

Figure 1:
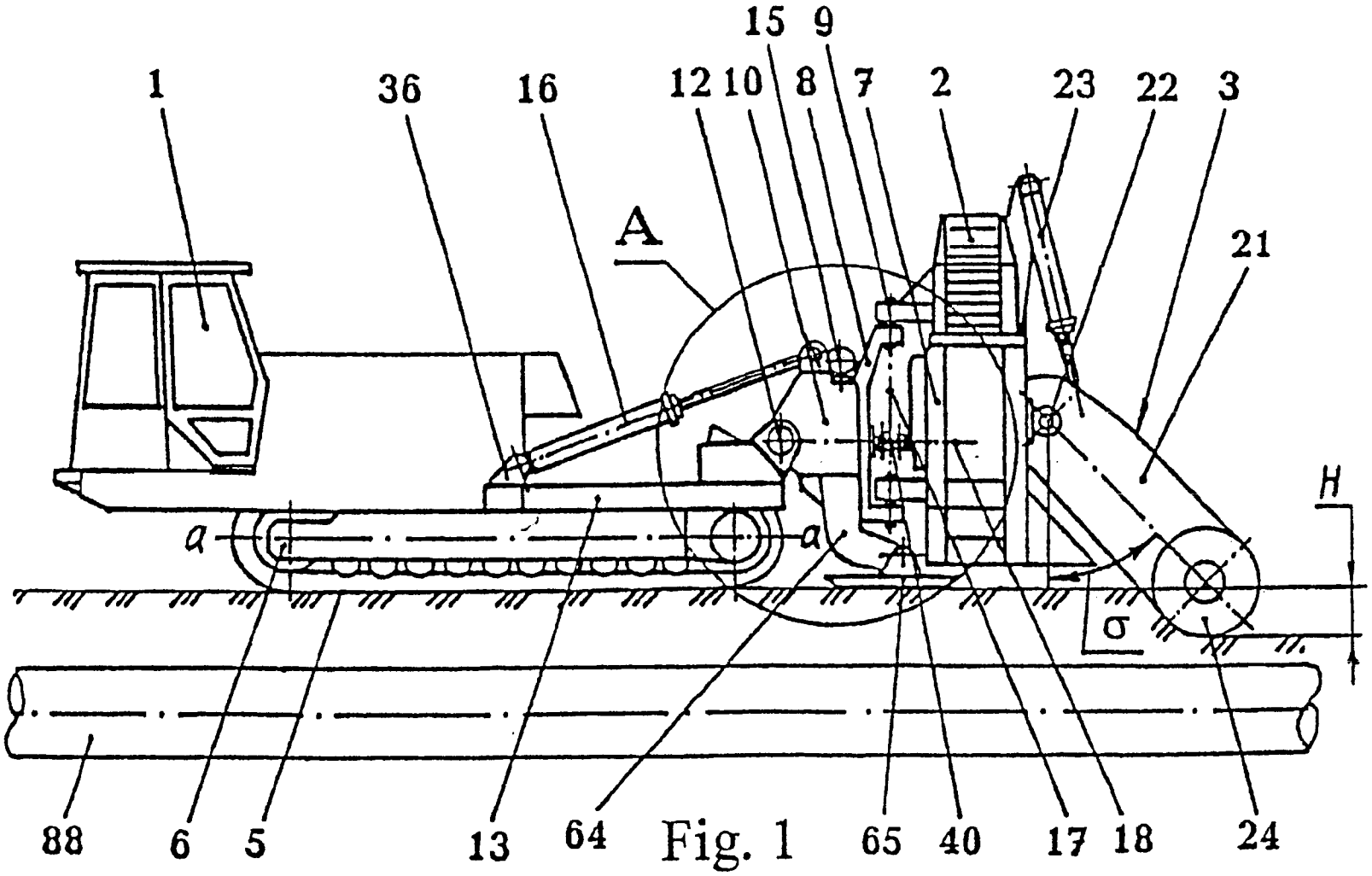
FIG. 1 represents the claimed machine for digging into the lower layers of the ground in the nominal working position, side view.
Figure 2:
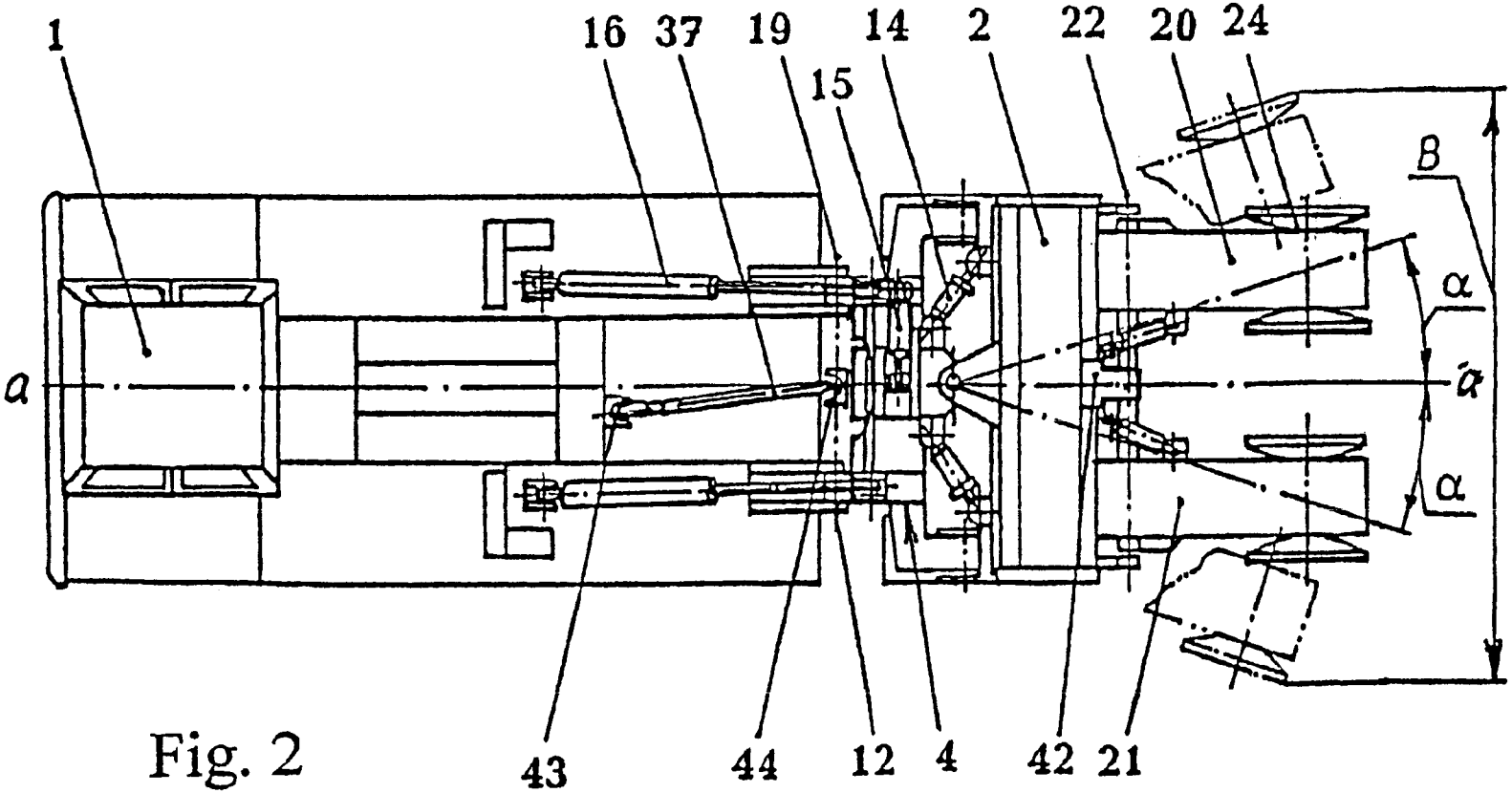
FIG. 2—the same, top view.

The claimed machine for digging into the lower layers of the ground consists of base frame 1, ground excavator 2, working organ 3 and device 4 of suspension of the working organ 3 from base frame 1. The above device 4 can have different designs. For a general embodiment of the invention, it is only essential for device 4 to provide the possibility of forced rotation of working organ 3 about at least two geometrical axes, the first of which in the nominal working position of the machine is normal to support surface 5, for instance, to the caterpillar drive section 6 of base frame 1. The second of the above geometrical axes of rotation of the working organ in the nominal working position of the machine is parallel to longitudinal axis "a—a" of drive section 6. In this case, the first geometrical axis relative to base frame 1 should be able to rotate about the second geometrical axis. Only in this case it becomes possible to dig excavations with a bottom that is horizontal or having a predetermined lateral inclination. The nominal working position of the machine in this case is understood to be the working position in which the machines are usually shown in the general view drawings (see FIGS. 1, 2, 4).

In the preferable embodiment device 4 is made in the form of the first frame 7 which carries ground excavator 2 and working organ 3, second frame 8 which relative to first frame 7 is located from the side of base frame 1 and is connected to it by first hinged joint 9, third frame 10 which is connected by second hinged joint 11 with second frame 8 and by third hinged joint 12 with frame 13 of base frame 1, and power drives made, for instance, in the form of hydraulic cylinders 14, 15, and 16 for performance of forced rotation in the first, second and third hinged joints. Thus, in this embodiment of device 4 second frame 8 is hinged on frame 13 of base frame 1 by means of a device which includes second hinged joint 11, third frame 10 and third hinged joint 12. However, within the scope of this invention, other embodiments of the machine are possible, in which second frame 8 can be suspended from frame 13 of base frame 1 by means of a device including only second hinged joint 11.

Geometrical axes 17, 18 of first 9 and second 11 hinged joints, respectively, are the above-mentioned first and second geometrical axes of rotation of working organ 3 and are located as indicated above. Geometrical axis 19 of third hinged joint 12 is normal to longitudinal axis "a—a" and parallel to support surface 5 of drive section 6. Geometrical axis 18 is located above the center of mass of that part of the machine which can rotate about axis 17 and incorporates first frame 7 with ground excavator 2 and working organ 3.

Working organ 3 is made in the form of two chain portions 20, 21 mounted on the rear edge of first frame 7 with the capability of forced rotation about geometrical axis 22 of their drive shafts by means of a power drive made in the form, for instance, of hydraulic cylinders 23. Tension shaft of each chain portion 20, 21 is connected to face milling cutters 24. Ground excavator 2 can be made in the form of a strip or other conveyer belt or, for instance, in the form of thrower 2 as shown in the drawings FIGS. 1–4. In this case first frame 7 is made in the form of case of thrower 2.

Second frame 8 is made detachable in the form of front 25 and rear 26 semi-frames which are fastened to each other by flange joint 27 located in the plane which is normal to geometrical axis 18 of second hinged joint. Semi-frames 25, 26 form a closed gap which accommodates transverse beam 28 of third frame 10, which beam is connected to semi-frames 25, 26 by means of the above second hinged joint 11. Side panels 29 of third frame 10 are rigidly fastened to end faces of transverse beam 28 and are hung by two hinges with tubular axles 30 which form third hinged joint 12, from brackets 31 rigidly fastened in the stem part of frame 13 of base frame 1. In this case, brackets 32 connected to each other by hydraulic cylinder 15, are fastened on the upper planes of one of the side panels 29 and front semi-frame 25. Brackets 33, 34 are made on side surfaces of rear semi-frame 26 and front edge of first frame 7, the brackets being connected to each other by hydraulic cylinders 14. Upper planes of side panels 29 and frame 13 carry brackets 35, 36 connected to each other by hydraulic cylinders 16.

Figure 6:
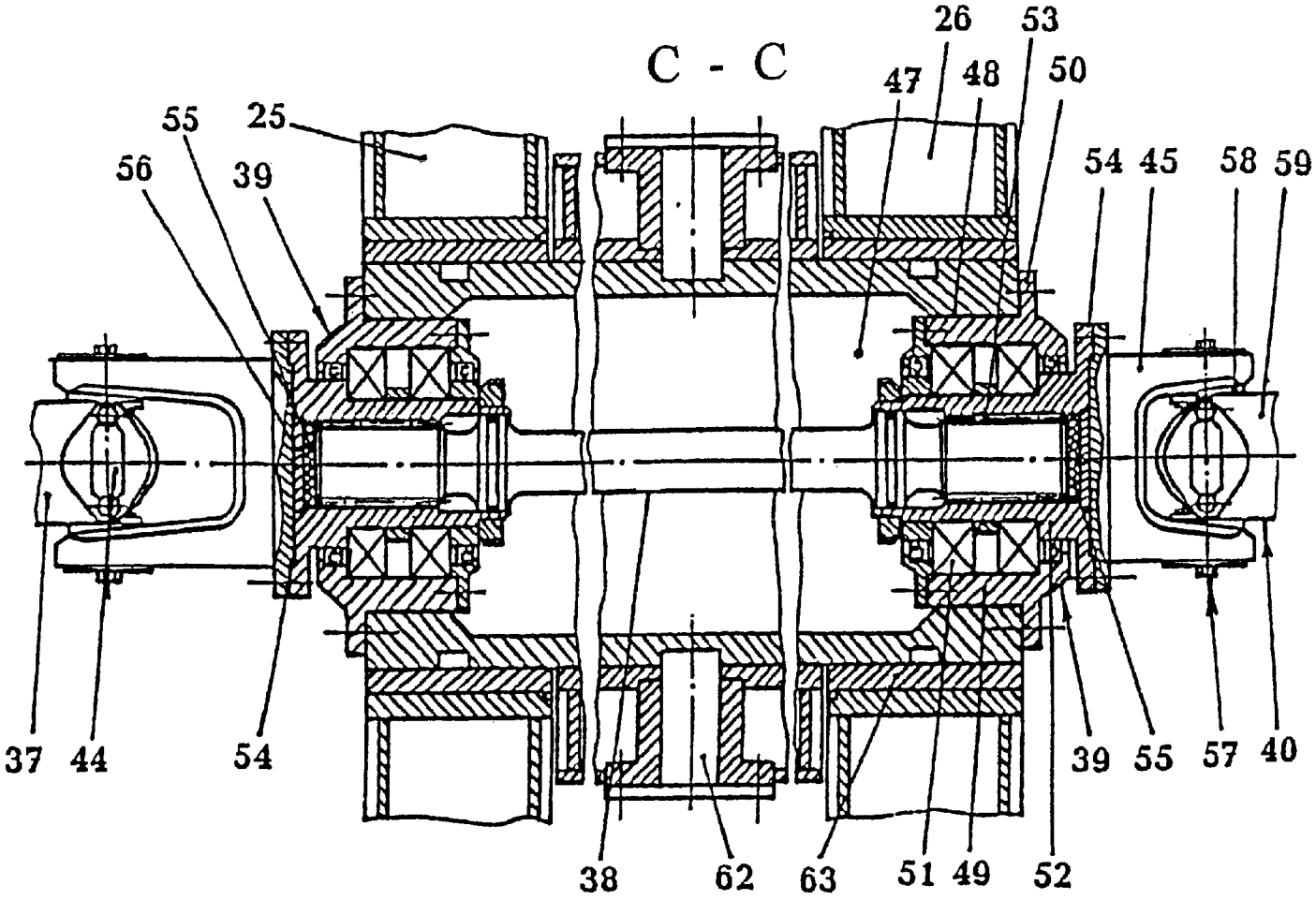
FIG. 6—section C—C in FIG. 5.

Drive of ground excavator 2 and working organ 3 can be made using electric motors, hydraulic motors, combustion engines, or, for instance, in the preferable embodiment of the invention, as a power drive from PTS of the base frame as shown in the drawings. In this case, the above drive in made in the form of a telescopic cardan shaft 37, intermediate shaft 38 with bearings supports 39, gimbal drive 40 and part of the drive which is mounted on the first frame 7 (thrower case) and includes distribution box 41 and distribution reduction gear 42. First cardan joint 43 of cardan shaft 37 is connected to PTS, and second cardan joint 44 is connected to the first end of intermediate shaft 38 whose second end is connected to first jaw 45 of gimbal drive 40 whose second jaw 46 is connected to input shaft of distribution box 41. In this case second hinged joint 11 includes tubular axle 47 with co-axial cylindrical holes 48 into which cylindrical parts 49 of bearing supports 39, are fitted. Cases 49 are fastened on the end faces of tubular axle 47 by means of flanges 50. Bearing supports 39 are made in the form of sleeves 52 mounted in their cases 49 on bearings 51, the sleeves accommodating the ends of intermediate shaft 38, and are connected to them by keyed or, as shown in FIG. 6, splined joints 53. Sleeves 52 are connected by flange joints 54 to first jaw 45 of gimbal drive 40 and to the jaw of second cardan joint 44 of cardan shaft 37.

Sleeves 52 are fitted with elastic gaskets 55, for instance, of rubber, located between their end faces and end faces of intermediate shaft 38. The above end faces of sleeves 52 are formed by end faces of plugs 56. In the preferable embodiment of the machine, intermediate shaft 38 is made as a torsion shaft, i.e. having sufficient torsional elasticity.

Figure 4:
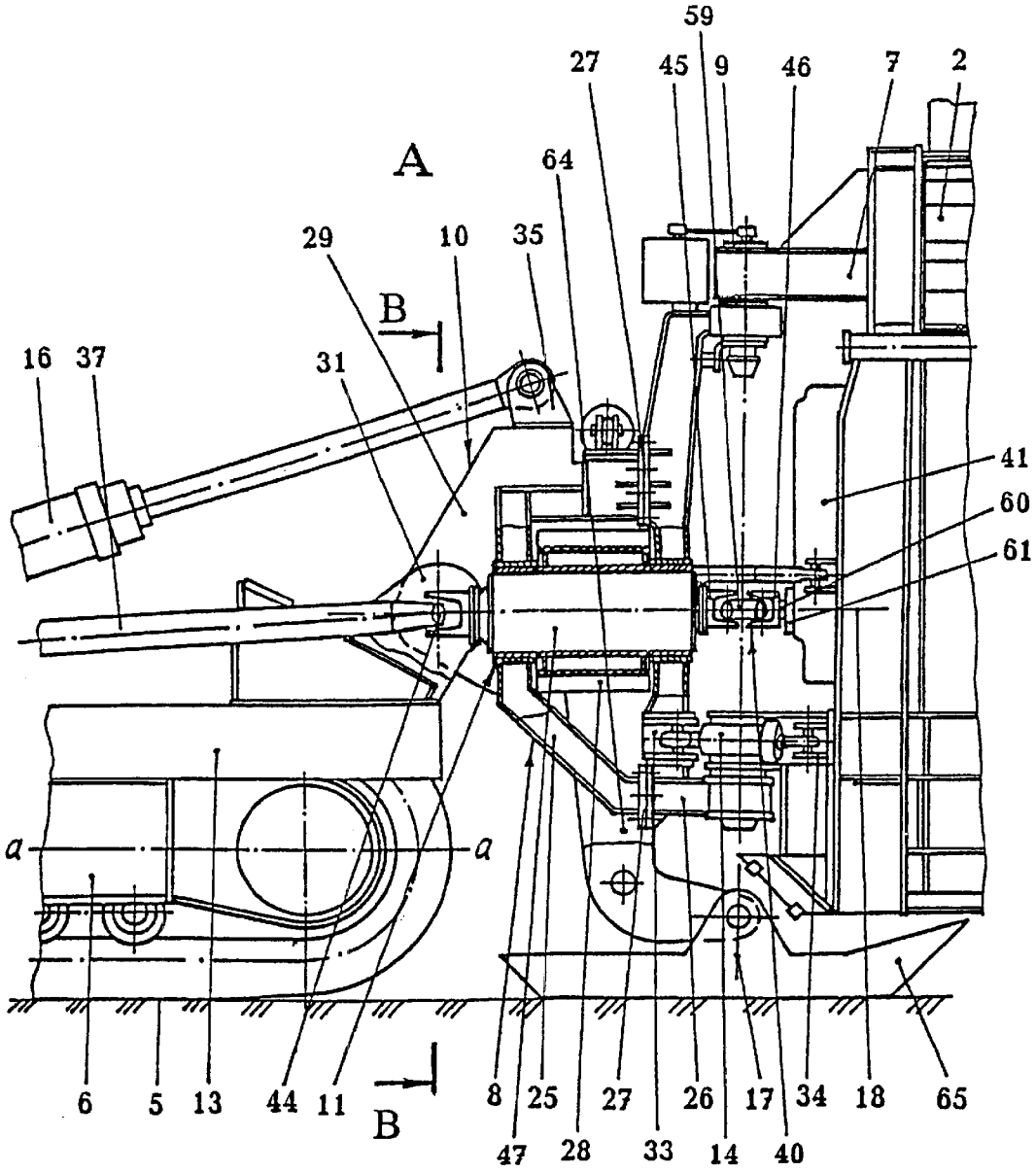
FIG. 4—assembly A in FIG. 1.
Figure 5:
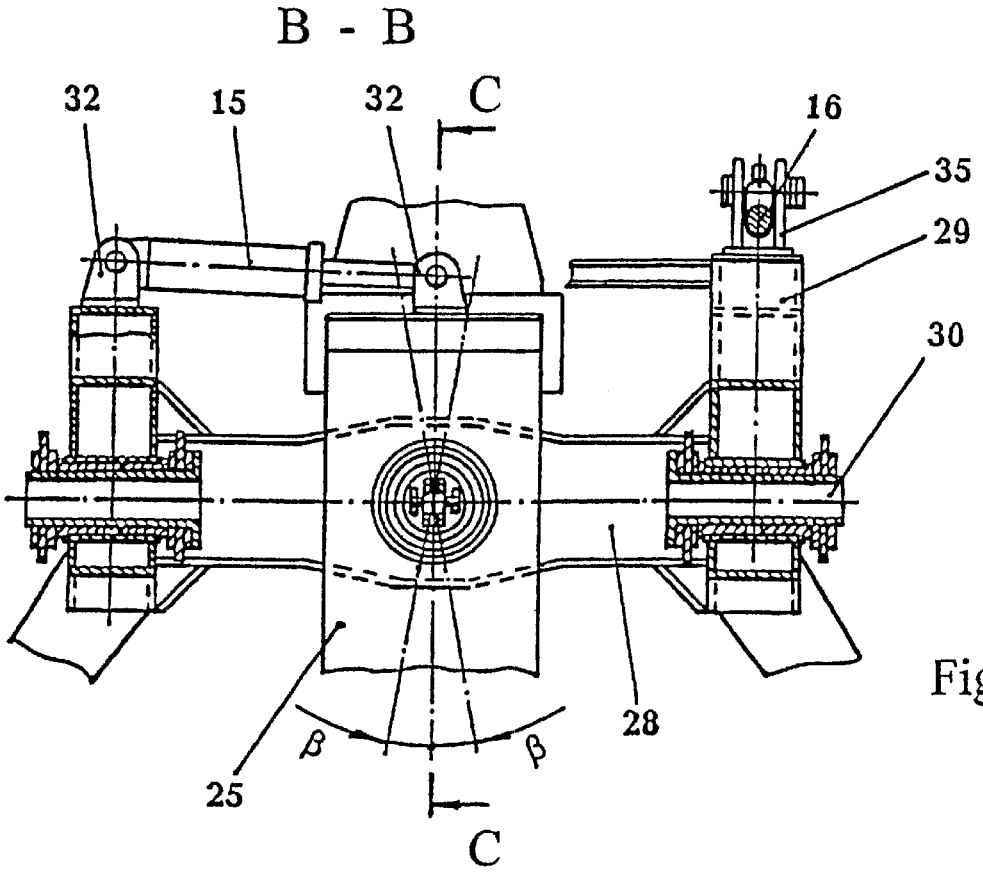
FIG. 5—section B—B in FIG. 4.

The geometrical center of cardan joint 44 coincides with the point of intersection of geometrical axes 18, 19. Gimbal drive 40 can incorporate both one cardan joint (not shown in the drawing), and two cardan joints 57 whose geometrical centers in the nominal working position are symmetrical to the point of intersection of geometrical axes 17, 18 (FIG. 4). Cardan joints 57 are formed by jaws 45, 46, two cross-pieces 58 and double middle jaw 59. Jaw 46 has stem 60 fitted into a hole of input shaft 61 of distribution box 41 and connected to the latter by a keyed or preferably spliced joint (not shown in the drawing).

The middle part of tubular axle 47 enters a cylindrical hole of transverse beam 28 and is secured against rotation or axial displacement by fingers 62. The end parts of tubular axle 47 fit with the capability of rotation and axial displacement into the cylindrical holes of bearing busings 62 press-fitted into the holes of semi-frames 25, 26.

Third frame 10 is fitted with posts 64 with skids 65 hinged to their lower ends in order to unload the rear axles of drive section 6 and provide self-orientation of working organ 3 relative to the ground surface.

Figure 7:
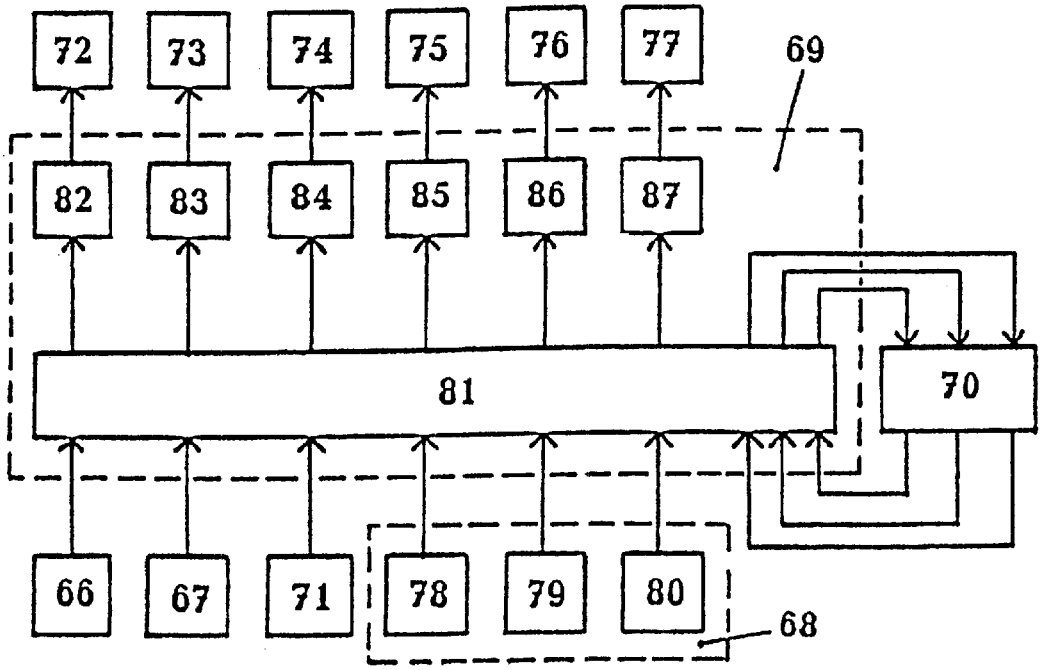
FIG. 7—block-diagram of the automatic control system.

In the preferable embodiment, the machine is fitted with a system for automatic control of hydraulic cylinders 14, 15, which is made in the form of transducers 66, 67 of angle of rotation $\beta$ in second hinged joint 11 and angle $\gamma$ (not shown in the drawing) of lateral inclination of base frame 1 relative to the axis of gravity (vertical or horizontal), means 68 of control of rotation in first hinged joint 9, block 69 of information processing and generation of control signals and panel 70 of indication and control. The above system for provision of automatic control of hydraulic cylinders 23 is fitted with transducer 71 or angle $\sigma$ of rotation of chain portions 20, 21 of working organ 3. Transducers 66, 67, 71 and means 68 are connected to first inputs of block 69 whose control signal outputs are connected to controls of hydraulic cylinders 14, 15, 23, for instance, by electric magnets 72, 73, 74, 75, 76, 77 of solenoid-operated hydraulic distributors, by means of which the head and rod ends of the above hydraulic cylinders can be connected to the pressure hydraulic line, to the drain or to each other in a manner generally known in hydraulics. The inputs of panel 70 are connected to the information outputs of block 69, and the outputs to the second inputs of block 69. Means 68 can be made in the form of transducer 78 of angle $\alpha$ of rotation in first hinged joint 9 or limit switches 79, 80 for signaling limit angle $\alpha$ or, for instance, as shown in FIG. 7, transducer 78 and limit switches 79, 80. Transducers 66, 71, 78 of angles $\beta$, $\sigma$, $\alpha$ can be made in the form of sine-cosine sychro resolvers, potentiometers or in some other known manner. Transducer 67 of $\gamma$ angle (not shown in the drawing) is made, for instance, in the form of a unified measurement module UIM-15M-2 designed for measurement of the angle relative to the gravity vertical. UIM-15M-2 module is mounted on base frame 1 near third frame 10. Block 69 is made, for instance, in the form of computer 81 with analog-digital converter (ADC) and block of output amplifiers 82, 83, 84, 85, 86, 87 whose inputs are connected to analog outputs of ADC of computer 81, and whose outputs are the above outputs of control signals of block 69. Information outputs of block 69 are digital or analog outputs of computer 81, depending on the type of indicators used in panel 70. The first and second inputs of block 69 are analog and digital inputs of computer 81, respectively. Computer 81 is made, for instance, on the base of a microprocessor complex K1821 and is designed to consist of processor boards, input-output ports and ADC. Panel 70 is designed to consist of a front panel which carries the toggle switches for selection of the operational modes and buttons for assigning the parameters, and a PC board on which the digital indicator connections are soldered, for instance, 490IP2, as well as additional elements providing co-ordination with computer 81.

The claimed machine operates as follows.

The machine is mounted in the site, for instance over pipeline 88 for grading the route and partial uncovering of pipeline 88. Working equipment of the machine is moved from transportation position (FIG. 3) into working position (FIG. 1, 2, 4), lowering third frame 10 by means of hydraulic cylinders 16 until skids 65 rest on the ground. Hydraulic cylinders 23 are used to lower working organ 3 until it touches the ground, hydraulic cylinders 14 are used to perform swinging motion of working organ 3 about axis 17 of first hinged joint 9 and machine movement, is begun, for instance by forward travel (FIG. 1), while simultaneously smoothly lowering working organ 3 into the ground. In the case if the surface of the ground on which the base frame is moving, has a lateral inclination, i.e. angle $\gamma$ is not zero, hydraulic cylinder 15 is used to rotate frame 8 about axis 18 of second hinged joint 11 until axis 17 reaches the vertical position in which angle $\beta$ is equal to angle $\gamma$. In this case the operator can be guided by the readings of indicators of angles $\beta$ and $\gamma$, or indicator of algebraic sum of angles $\beta$ and $\gamma$, which can be installed on panel 70 and onto which the appropriate numerical values are sent from computer 81.

The machine can provide the predetermined lateral inclination of bottom 89 of the excavation being dug, the sum of $\beta+\gamma$ being maintained equal to angle $\tau$ (not shown in the drawing) of lateral inclination of bottom 89. Machine control during grading (at $\beta+\gamma=0$) or maintenance of a predetermined lateral inclination of the bottom (at $\beta+\gamma=\tau$) can be performed in the automatic mode, in this case a setting of the numerical value of lateral inclination equal to zero or $\tau$ is entered from panel 70 into the memory of computer 81. Control signals are generated by computer 81 by calculation, after each cycle of measurement, of the algebraic sum of angle $\beta$ of working organ rotation about axis 18 and angle $\gamma$ of lateral inclination of base frame, whose values are read from transducers 66, 67 and comparison of this sum with the numerical value of the setting. If $\beta+\gamma$ differs from the numerical value of the setting (zero or $\tau$), a signal comes to electric magnet 72 or 73 and the appropriate electric magnet switches the respective solenoid-controlled hydraulic distributor of hydraulic cylinder 15 to rotation of frame 8 in the required direction. Control of hydraulic cylinder 15 is performed in the extreme points of swinging of frame 7 about axis 17 at the moment of stopping of hydraulic cylinders 14 for a certain time (about 0.5 s). During this time frame 7 can rotate by a limited angle (of about one degree). The extreme positions in rotation of frame 7 through maximal angle $\alpha$ are determined by signals of limit switches 79, 80 or transducer 78 of angle $\alpha$.

Figure 8:
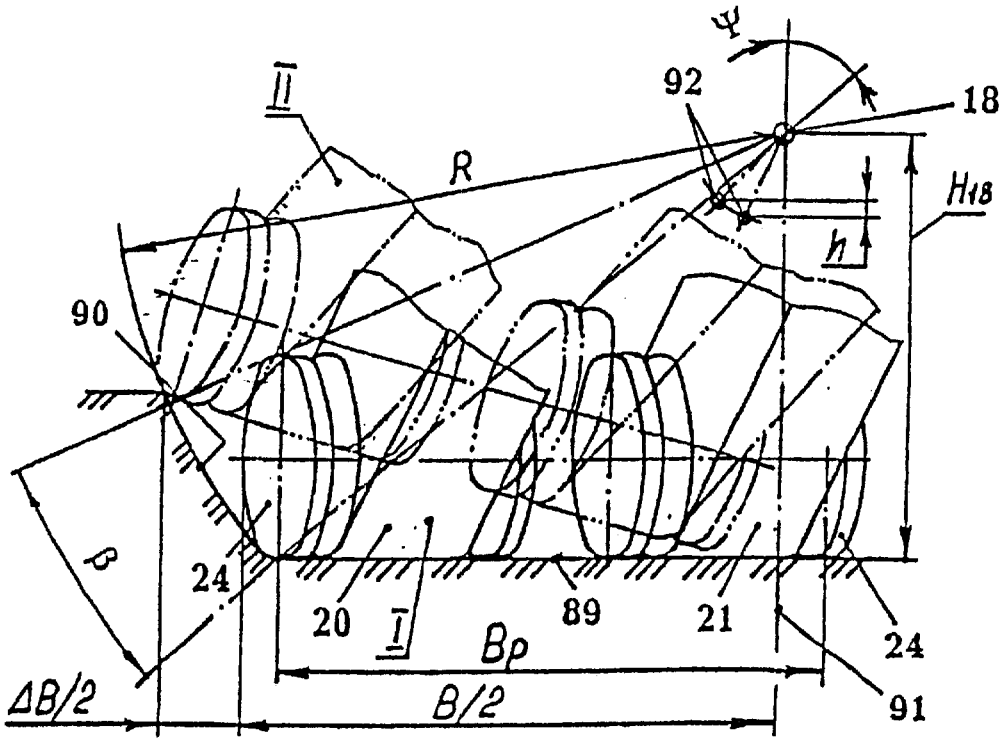
FIG. 8—schematic representation of the working organ in the extreme positions.

When it is necessary to form slopes 90, control of hydraulic cylinders 14, 15 in the manual or, preferably, automatic modes, is performed as follows. In rotation of frame 7 by a maximal angle $\alpha$ (position I of working organ in FIG. 8), electric magnets 74, 75 are deenergized, and head ends of hydraulic cylinders 14 are locked, here frame 7 is secured against rotation. At the same time, a signal is fed to one of the electric magnets 72, 73 which switches hydraulic cylinder 15 to rotation of frame 8 about axis 18 with displacement of working organ 3 towards slope 90 which is formed when the working organ moves from position I into position II in FIG. 8. When frame 8 rotates to a maximal angle $\beta$ (working organ 3 in position II in FIG. 8), reversal of hydraulic cylinder 15 is performed by a change in powering electric magnets 72, 73, and at the moment when the algebraic sum of $\beta+\gamma$ reaches the required value (zero or $\tau$) both electric magnets are deenergized, the head ends of hydraulic cylinder 15 being locked and frame 8 being secured against rotation about axis 18. The appropriate electric magnet 74 or 75 is powered at the same time, for performance of rotation of frame 7 towards the opposite slope. As a result of the above successive rotation of working organ 3 about axes 17, 18, slopes 90 are formed, and width B of the excavation being dug is increased by the value of $\Delta B$. The slope angle and $\Delta B$ value depend on angle $\psi$ (FIG. 8) which is given by the ratio width $B_w$ of working organ and height $H_{18}$ from axis 18 to bottom 89, since rotation of working organ 3 about axis 18 for formation of slopes 90 is possible without distortion of middle part of bottom 89 only in the case, if by the moment of its start, the extreme right (FIG. 8) face milling cutter 24 have come up to plane 91 which is normal to bottom 89 and to which axis 18 belongs. That is, for a narrower working organ 3, for instance made of one chain portion 20, 21, angle $\psi$ can be smaller, and angle of slope 90 and $\Delta B$ value can be larger. In this case angle of slope and $\Delta B$ value can be increased, if rotation of working organ 3 about axis 18 is combined with rotation about axis 22 by means of hydraulic cylinders 23, increasing angle $\sigma$ simultaneously with increase of angle $\beta$ and vice versa. Coordinated control of hydraulic cylinders 15, 23, is performed by computer 81, after processing the information of transducers 66 and 71 and forming by an appropriated program, the signals at the outputs of amplifiers 82, 83 and 86, 87 connected with electric magnets 72, 73 and 76. Furthermore, with coordinated rotation about axes 17, 18 kinetic energy $E_{17}$ stored by frame 7, ground excavator 2 and working organ 3 with the total mass m in center 92 at its rotation with speed $V_{17}$ about axis 17, is converted into kinetic energy $E_{k18}$ of rotation of center of mass 92 about axis 18 and potential energy $E_n$, when center of mass 92 is lifted to height h. The stored potential energy $E_n$=mgh in rotation from position II into position I (FIG. 8) is converted into kinetic energy $K_{K18}$ with subsequent conversion into $E_{k17}$. Angles $\alpha$ (in the plane normal to axis 17, not shown in the drawing) and $\phi$ (in the plane normal to axis 18) between vectors of velocities $V_{17}$, $V_{18}$, determine certain dynamic loads on metal structures of the working equipment and base frame at the moment of transition from rotation about axis 17 into rotation about axis 18, and vice versa. Considering, however, that these angles can be quite small (up to 20 degr.), dynamic loads are much smaller than with complete stoppage of frame 7 in the extreme position of rotation about axis 17. Velocity $V_W$ of the extreme point of working organ 3 and velocity $V_{18}$ of center of mass 92 in rotation about axis 18 are connected by a mathematical dependence:

$$V_p=V_{18}-R/r_1$$

where R and r are radii of rotation about axis 18 of extreme point of working organ 3 and center of mass 92, respectively.

Figure 9:
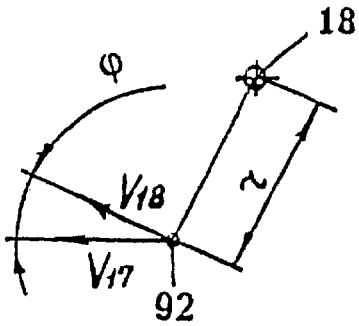
FIG. 9—velocity diagram.

It is preferable for radius r of rotation of center of mass 92 about axis 18 to be large enough, and for angles $\alpha$ and $\phi$ to be small enough, in this case loss of kinetic energy and the dynamic loads will be quite small at relatively high velocities $V_{17}$, $V_{18}$. The above is true, if the center of mass 92 is located below axis 18, this being obvious from FIGS. 8, 9.

Figure 10:
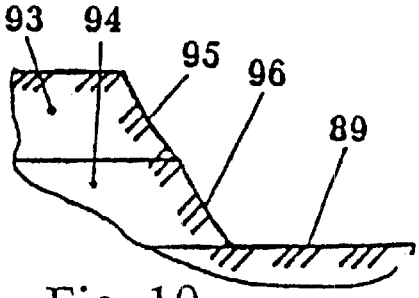
FIGS. 10, 11—profiles of the dug excavations.

FIG. 10 shows the profile of an excavation which is dug by the machine in two passes when removing two layers of the ground 93; 94 with formation of slopes 95, 96. It is obvious that when removing the second layer, it is necessary to reduce angle $\alpha$ of swinging of working organ 3 about axis 17. This is more convenient to perform if transducer 78 is available. In this case the appropriate setting of the largest angle $\alpha$ is entered into the memory of computer 81 from panel 70, and at the moment when the value of angle $\alpha$ read from the transducer 78 becomes equal to the value of the setting, the computer generates a signal for deenergizing electric magnets 72, 73.

Figure 11:
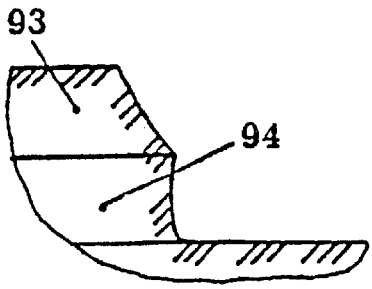

FIG. 11 shows a profile of an excavation in digging of which no sloping was done when second layer 94 of the ground was removed, angle $\alpha$ of swinging being constant when both ground layers were removed.

In addition, the machine is capable of providing the formation of a cylindrical bottom of the excavation, for instance, for laying a pipeline of a large diameter. Swinging of the working organ is mainly performed about axis 18 (not shown in the drawing).

Figure 3:
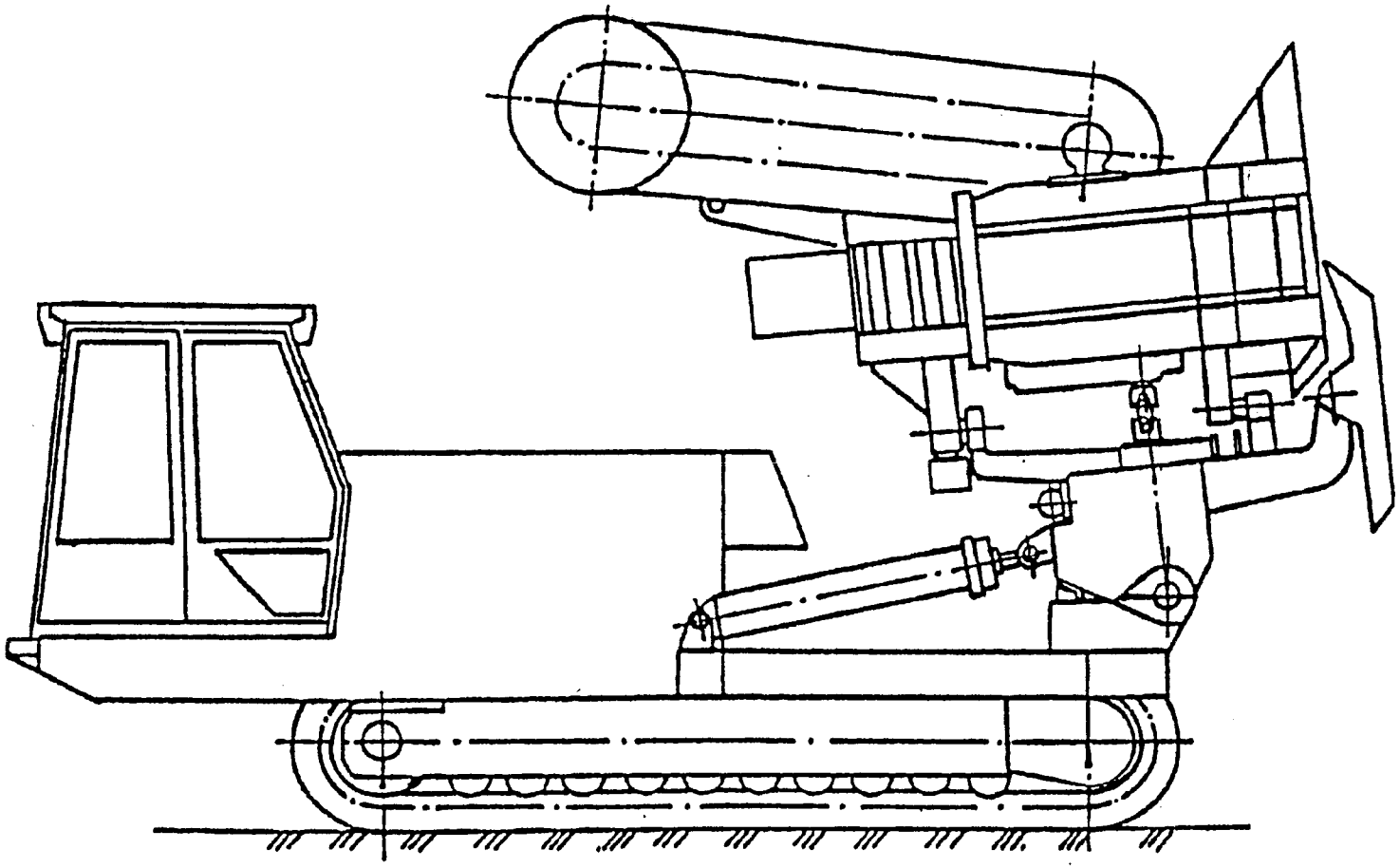
FIG. 3—claimed machine in the transportation position, side view.

Availability of transducer 71 of angle $\sigma$ enables the machine to maintain in the automatic mode the assigned value H of the working organ lowering into the ground. In this case computer 81 calculated lowering H by angle $\sigma$ and compares it with the value of the appropriate setting which has been entered from panel 70 into memory of computer 81 in advance. In the case of a discrepancy between values of lowering H and of the appropriate setting, signals for switching hydraulic cylinders 23 by means of one of the electric magnets 76, 77 to lowering or withdrawal of working organ 3 are formed at the outputs of amplifiers 86, 87. Lowering (withdrawal) of working organ 3 occurs in the extreme points of swinging of working organ 3 (position I in FIG. 8) at the moment of stopping of swinging cylinders 14 for a time of about 0.5 s, or during rotation of working organ from position II into position I in FIG. 8. During this time the working organ can be lowered (withdrawn) to a limited height (about 5 cm). Panel 70 can have a digital indicator to which numerical value of H is sent from computer 81, which can be used by the operator for control of lowering (withdrawal) of working organ in the manual mode. After completion of the work, the working equipment is brought into the transportation position for machine movement to a new location (FIG. 3).

What is claimed is:

1. A machine for digging into the lower layers of the ground comprising:

a base frame having a drive section including a support surface, a ground remover;

a working organ, a first suspension device for suspending the working organ from the base frame, said first suspension device comprising first and second frames and a first hinged joint connecting said first and second frames, a second suspension device comprising a second hinged joint, said first hinged joint having a first geometrical axis, said second hinged joint having a second geometrical axis, said first frame carrying the working organ, said second frame being suspended from the base frame by means of the second hinged joint, and first and second power drives for rotating the first and second frames along the first and second hinged joints respectively, wherein the first geometrical axis of the first hinged joint is normal to the support surface of the drive section of the base frame, and the second geometrical axis of the second hinged joint is parallel to the longitudinal axis of the drive section of the base frame when the machine is in a nominal working position.

2. The machine according to claim 1, further comprising a rotatable part which includes the working organ and has the capability to rotate about the first geometrical axis of the first hinged joint, wherein the second geometrical axis of the second hinged joint is located about the center of mass of the rotatable part.

3. The machine according to claim 1, further comprising a drive shaft with a geometrical axis, said first frame having a first edge and a second edge facing said base frame, said second frame having an edge connected to said second edge of said first frame, and wherein the working organ comprises at least one chain portion mounted on a first edge of the first frame, said chain portion having the capability of rotation about the geometrical axis of the drive shaft by the action of a power drive for driving the chain.

4. The machine according to claim 3, wherein the second suspension device comprise:

a third frame, a third hinged joint which connects a frame of the base frame to the third frame, and a third power drive for rotation in the third hinged joint, said third frame having a transverse beam, said third hinged joint having a geometrical axis, wherein the geometrical axis of the third hinged joint is normal to a longitudinal axis of the machine and parallel to the support surface of the drive section of the base frame, wherein the second frame is detachable and comprises front and rear semi-frames and flange joints attaching said front semiframe to said rear semiframe, wherein said flange joints are located in a plane which is normal to the geometrical axis of the second hinged joint, wherein said front and rear semiframes define a closed gap which accommodates the transverse beam of the third frame, and wherein said transverse beam is connected to said front and rear semiframes by the second hinged joint.

5. The machine according to claim 3, wherein the base frame has a power take-off shaft, the second hinged joint comprises a tubular axle and coaxial cylindrical holes disposed within said second hinged joint, the machine further comprises a power drive system for driving the working organ and ground remover, said power drive system comprising:

a cardan shaft connected to the power take-off shaft, an input shaft, a gimbal drive mounted on the first frame, an intermediate shaft having two bearing supports, each bearing support having a cylindrical case, said intermediate shaft connected at one end to the cardan shaft and at a second end to the gimbal drive, and wherein said cylindrical cases of said bearing supports of said intermediate shaft are fitted into said coaxial holes of said second hinged joint.

6. The machine according to claim 5, wherein: said bearing supports further comprise bearings and sleeves mounted in said cases on said bearings, wherein the sleeves accommodate the ends of the intermediate shaft, wherein the ends of said intermediate shaft are positioned into said sleeves and are connected to said sleeves by joints; and wherein said power drive system further comprises flange joints connecting said sleeves to the cardan shaft and the gimbal drive, and elastic gaskets fitted on said sleeves between end faces of said sleeves and the end faces of intermediate shaft.

7. The machine according to claim 6, wherein the intermediate shaft comprises a torsion shaft.

8. The machine according to claim 1, further comprising an automatic control system comprising:

transducers for measuring the angle of rotation $\beta$ of the second hinged joint and the angle of lateral inclination $\gamma$ of the base frame relative to a gravity axis, a first power drive controller for controlling the rotation in the first hinged joint, a second power drive controller for controlling the rotation in the second hinged joint, an information processor and control signal generator block said block having:

first inputs, said first inputs connected to said transducers measuring angles $\beta$ and, $\gamma$ and to said controller, second inputs, control signal outputs connected to said first and second power drive controllers of the first and second power drives for performance of rotation in the first and second hinged joints, and information outputs, an indicator and control panel having inputs and outputs, wherein said inputs of said indicator and control panel comprise the information outputs of said information processor and control signal generator block, and wherein said second inputs of said information processor and control signal generator block comprise said outputs of said indicator and control panel.

9. The machine according to claim 3 wherein the automatic control system further comprises a transducer for measuring the angle of rotation σ of the chain portion of the working organ, the information processor and control signal generator block further comprises an additional input, such that the transducer for measuring the angle of rotation σ is connected to the additional input, the machine further comprises a controller for the power drive for driving the chain, and wherein said indicator and control panel have additional control signal outputs connected to said controller.

10. The machine as in claim 6, wherein said joint which connects an end of said intermediate shaft is a keyed joint.

11. The machine as in claim 6, wherein said joint which connects an end of said intermediate shaft is a splined joint.

12. The machine as in claim 8, wherein said first power drive controller includes a transducer for measuring an angle α.

13. The machine as in claim 8, wherein said first power drive controller includes a limit switch.

14. The machine as in claim 8, wherein said second power drive controller includes a transducer for measuring an angle α.

15. The machine as in claim 13, wherein said second power drive controller includes a limit switch.

* * * * *